US010458755B1

(12) United States Patent
Gonzales, Jr.

(10) Patent No.: US 10,458,755 B1
(45) Date of Patent: Oct. 29, 2019

(54) PACKAGE DELIVERY BLIND

(71) Applicant: Robert Gonzales, Jr., San Antonio, TX (US)

(72) Inventor: Robert Gonzales, Jr., San Antonio, TX (US)

( * ) Notice: Subject to any disclaimer, the term of this patent is extended or adjusted under 35 U.S.C. 154(b) by 0 days.

(21) Appl. No.: 15/865,453

(22) Filed: Jan. 9, 2018

(51) Int. Cl.
*B65D 90/00* (2006.01)
*F41H 3/02* (2006.01)
*B65D 25/36* (2006.01)
*B65D 79/00* (2006.01)

(52) U.S. Cl.
CPC ..... *F41H 3/02* (2013.01); *B65D 25/36* (2013.01)

(58) Field of Classification Search
CPC ..... F41H 3/02; B65D 25/36
USPC ..... 220/694; 150/154
See application file for complete search history.

(56) References Cited

U.S. PATENT DOCUMENTS 3,478,949 A * 11/1969 Richgels ..... B65D 5/20 206/472
3,862,876 A * 1/1975 Graves ..... E04G 21/28 150/901
3,949,527 A * 4/1976 Double ..... B65D 90/00 52/4
3,960,193 A * 6/1976 Davis ..... A47G 11/003 108/90
4,364,123 A 12/1982 Sam
4,709,430 A 12/1987 Nicoll
4,751,936 A 6/1988 Zibble
4,961,981 A * 10/1990 Keegan ..... A47C 29/006 150/154
5,364,156 A * 11/1994 Zerow ..... B60J 11/00 296/136.13
5,572,833 A * 11/1996 Allen ..... A01F 25/13 52/3
5,664,825 A * 9/1997 Henke ..... B60J 11/00 150/166
5,791,090 A * 8/1998 Gitlin ..... E04H 9/14 52/4
D408,552 S 4/1999 Latschaw
5,989,656 A * 11/1999 Soloman ..... B65D 77/0406 150/154
6,158,175 A 12/2000 Carter
6,394,528 B2 * 5/2002 Hoenack ..... B60J 11/00 150/160

(Continued)

FOREIGN PATENT DOCUMENTS

CA 1299462 4/1992

*Primary Examiner* — J. Gregory Pickett
*Assistant Examiner* — Niki M Eloshway

(57) ABSTRACT

The package delivery blind is a blind. The package delivery blind is adapted for use in an outdoor environment. The package delivery blind is configured for use with a package. The package delivery blind conceals a package left in an outdoor environment. The package delivery blind comprises a blind sheeting and a plurality of weights. The blind sheeting forms an opaque sheeting placed over the package. The blind sheeting prevents the package from being seen. The plurality of weights secure the edges of the blind sheeting such that the wind will not move the blind sheeting thereby attracting attention to the package delivery blind. In the first potential embodiment of the disclosure, the blind sheeting further comprises the visual patterns and forms of camouflage appropriate for the outdoor environment.

13 Claims, 6 Drawing Sheets

(56) References Cited

U.S. PATENT DOCUMENTS

| | | | | |
|---|---|---|---|---|
| 6,966,152 | B2 * | 11/2005 | Glynos | A01F 25/13 248/910 |
| 7,270,617 | B2 * | 9/2007 | Henning | A63C 19/12 473/451 |
| 8,156,975 | B1 * | 4/2012 | Pickering | A47C 31/113 135/115 |
| D806,488 | S * | 1/2018 | Cohen | D8/1 |
| 2002/0059970 | A1 * | 5/2002 | Lemieux | B60P 7/0876 150/154 |
| 2002/0162883 | A1 | 11/2002 | Arvonio | |
| 2003/0226846 | A1 * | 12/2003 | Horwath | B65F 1/16 220/287 |
| 2004/0194393 | A1 * | 10/2004 | Horman | E04B 1/66 52/3 |
| 2007/0204945 | A1 | 9/2007 | Ross | |
| 2011/0126873 | A1 | 6/2011 | Desouches | |
| 2013/0164469 | A1 * | 6/2013 | Artmann | A01M 31/025 428/35.2 |
| 2014/0205798 | A1 * | 7/2014 | Williams | F41H 3/02 428/138 |
| 2014/0260107 | A1 * | 9/2014 | Conti | B65D 65/00 53/461 |
| 2015/0147519 | A1 * | 5/2015 | Siegel | B60J 7/10 428/99 |
| 2015/0168009 | A1 | 6/2015 | Otway | |
| 2016/0123707 | A1 * | 5/2016 | Catlin | F41H 3/02 2/69.5 |

* cited by examiner

PACKAGE DELIVERY BLIND

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of weapons and other means of defense, more specifically, a flexible cover for concealing objects.

SUMMARY OF INVENTION

The package delivery blind is a blind. The package delivery blind is adapted for use in an outdoor environment. The package delivery blind is configured for use with a package. The package delivery blind conceals a package left in an outdoor environment. A common scenario for using the package delivery blind is to conceal a package left unattended by a commercial delivery service. The package delivery blind comprises a blind sheeting and a plurality of weights. The blind sheeting forms an opaque sheeting placed over the package. The blind sheeting prevents the package from being seen. The plurality of weights secure the edges of the blind sheeting such that the wind will not move the blind sheeting thereby attracting attention to the package delivery blind. In the first potential embodiment of the disclosure, the blind sheeting further comprises the visual patterns and forms of camouflage appropriate for the outdoor environment.

These together with additional objects, features and advantages of the package delivery blind will be readily apparent to those of ordinary skill in the art upon reading the following detailed description of the presently preferred, but nonetheless illustrative, embodiments when taken in conjunction with the accompanying drawings.

In this respect, before explaining the current embodiments of the package delivery blind in detail, it is to be understood that the package delivery blind is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the package delivery blind.

It is therefore important that the claims be regarded as including such equivalent construction insofar as they do not depart from the spirit and scope of the package delivery blind. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
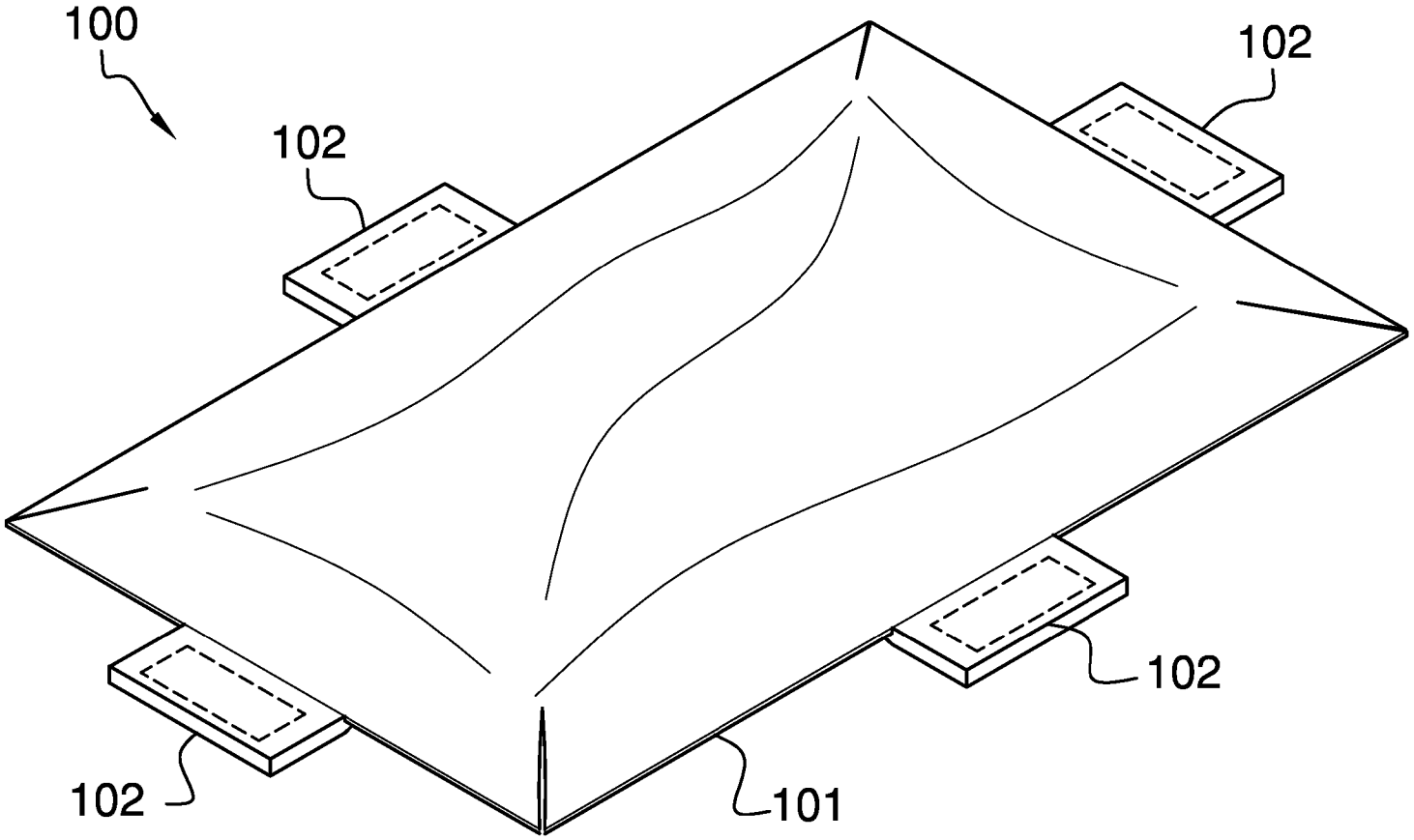
FIG. 1 is a perspective view of an embodiment of the disclosure.
Figure 2:
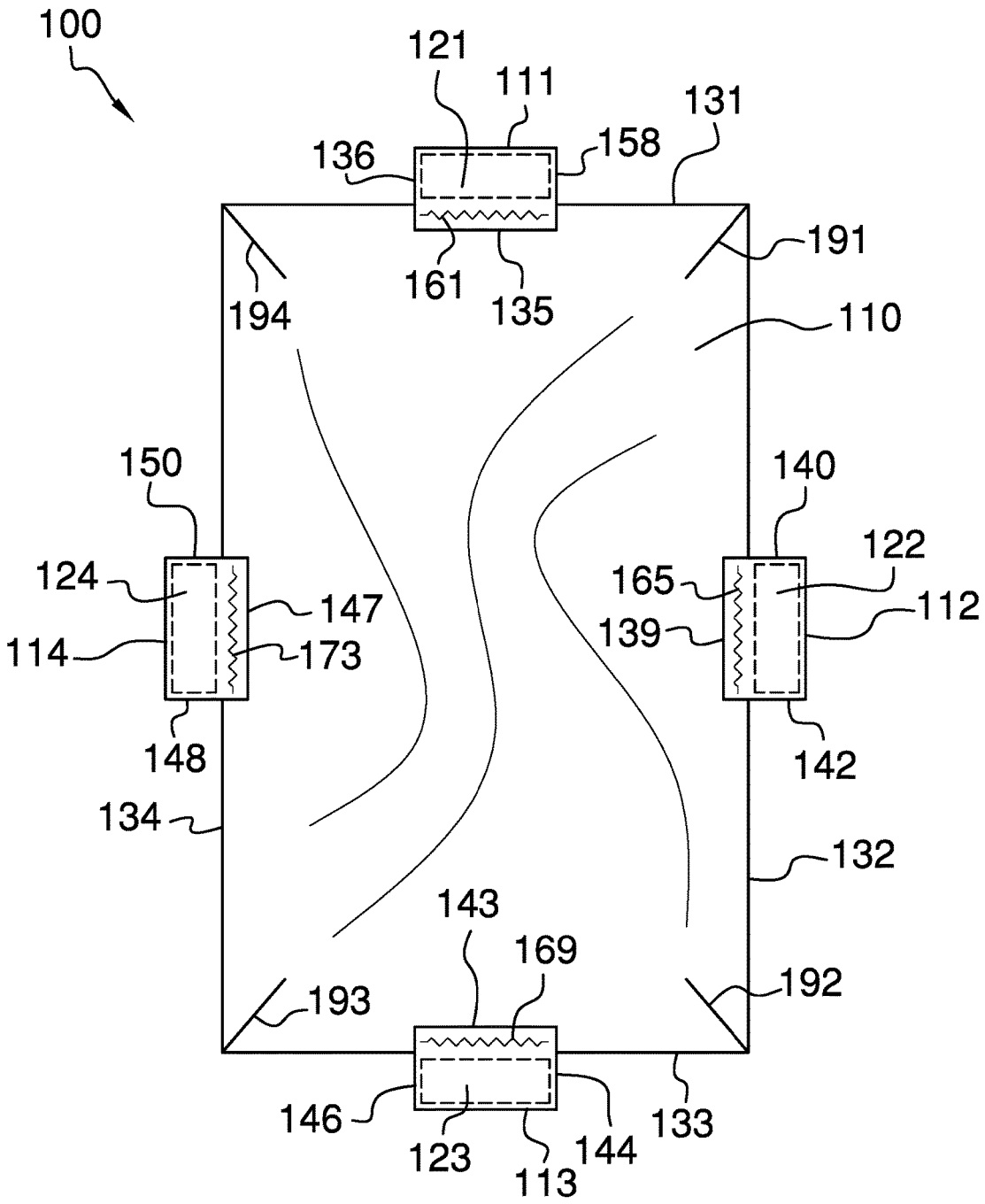
FIG. 2 is a bottom view of an embodiment of the disclosure.
Figure 3:
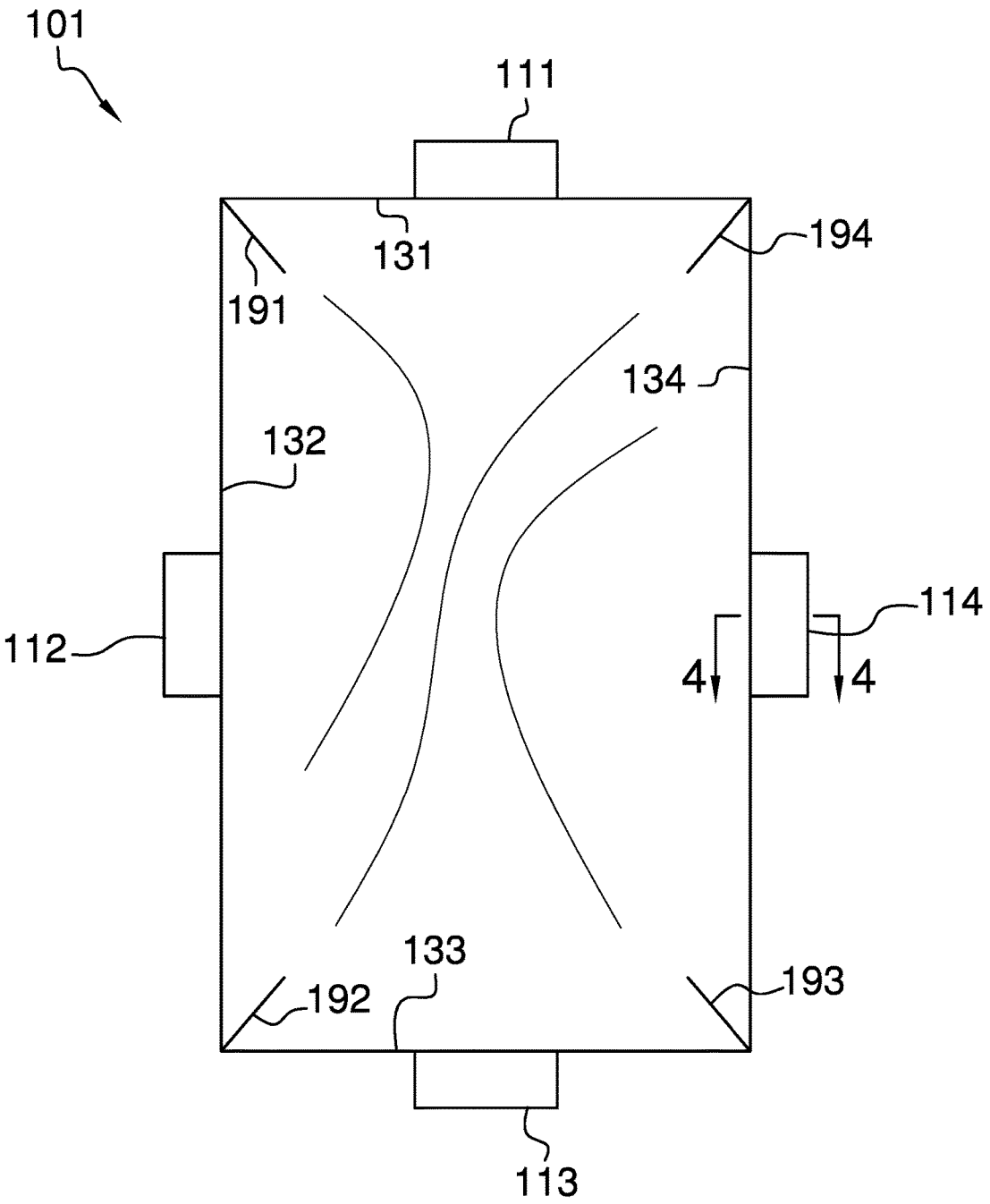
FIG. 3 is a top view of an embodiment of the disclosure.
Figure 4:
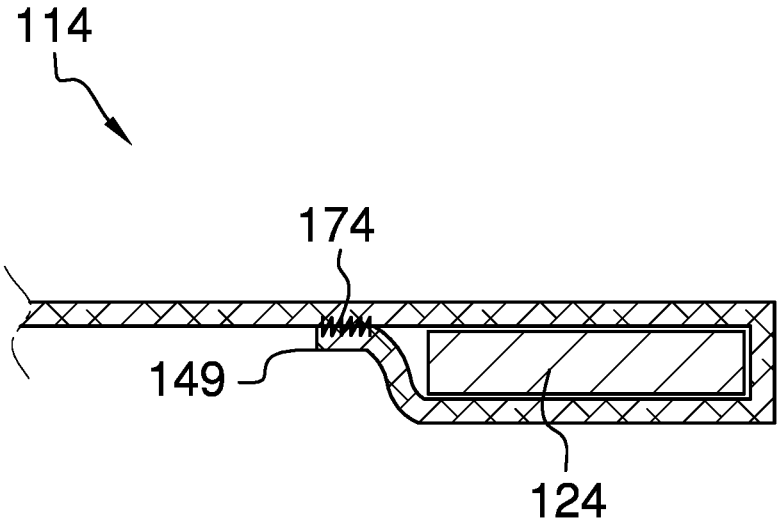
FIG. 4 is a cross-sectional view of an embodiment of the disclosure across 4-4 as shown in FIG. 3.
Figure 5:
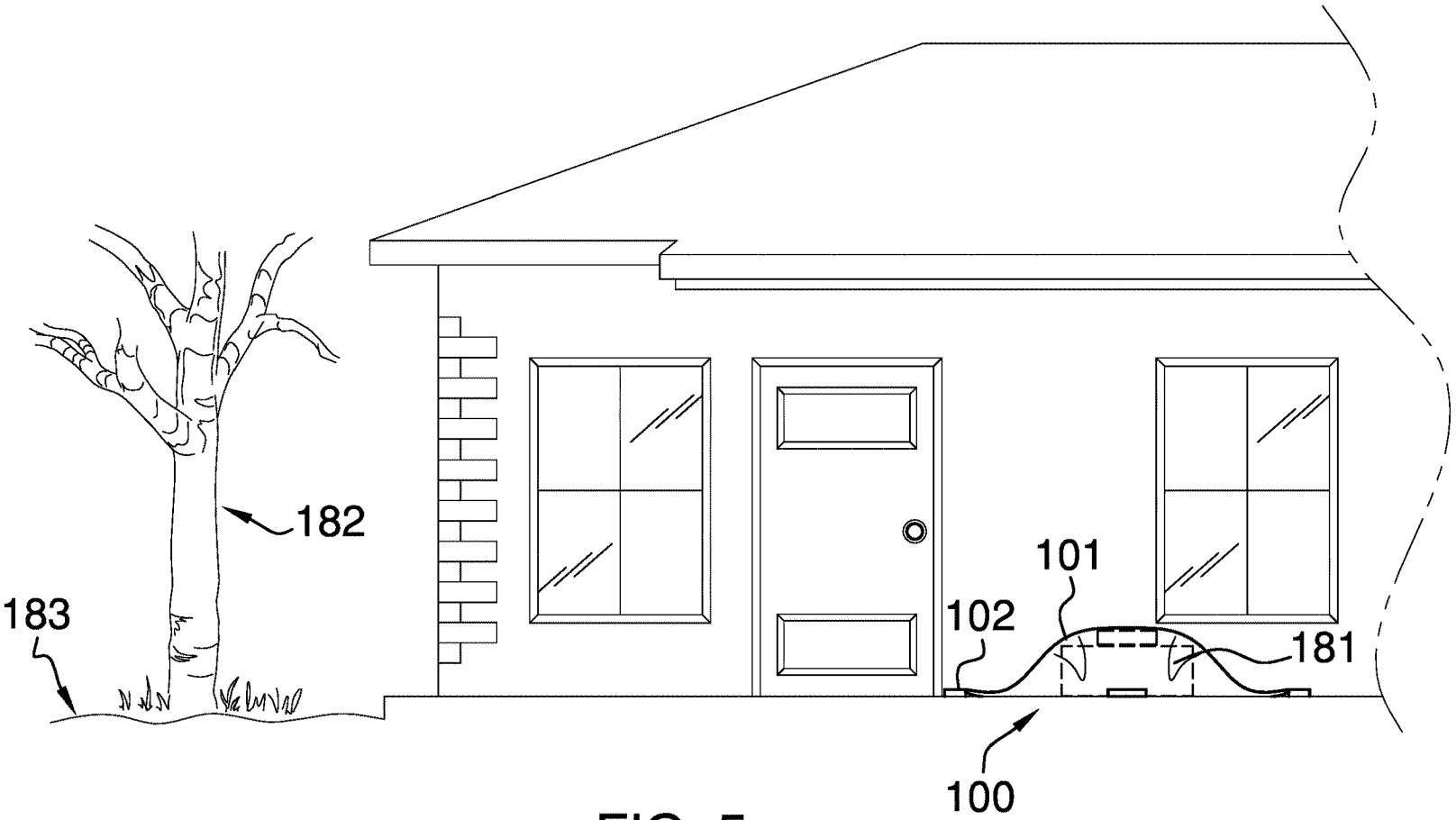
FIG. 5 is an in use view of an embodiment of the disclosure.
Figure 6:
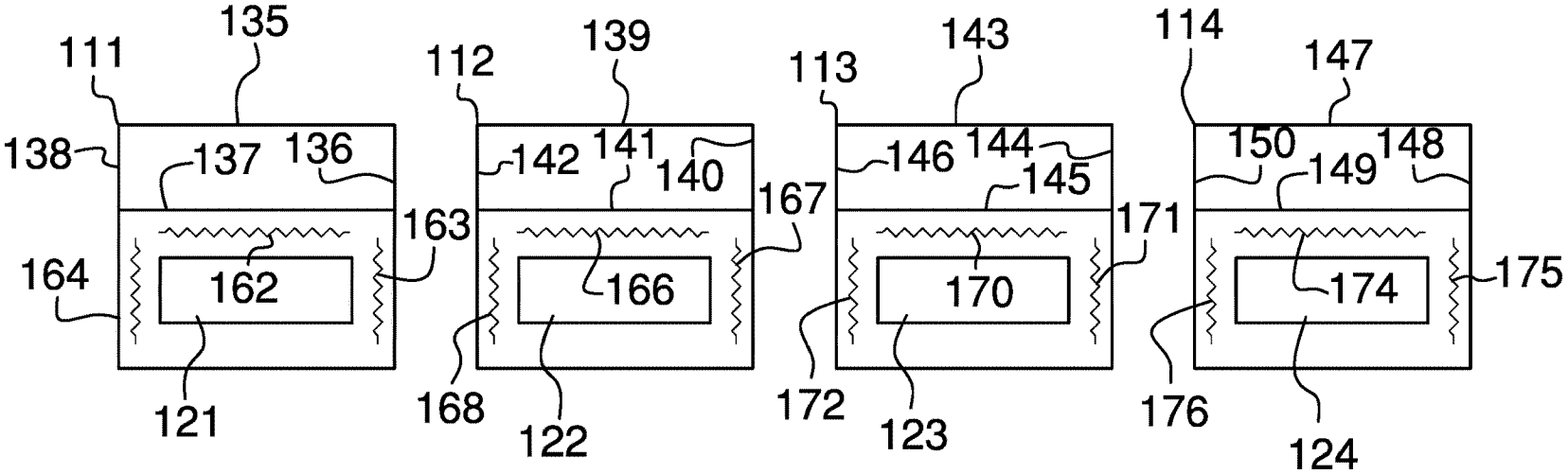
FIG. 6 is a detail view of an embodiment of the disclosure.

Detailed reference will now be made to one or more potential embodiments of the disclosure, which are illustrated in FIGS. 1 through 6.

The package delivery blind 100 (hereinafter invention) is a blind. The invention 100 is adapted for use in an outdoor environment 182. The invention 100 is configured for use with a package 181. The package 181 refers to an object that is intended to be temporarily concealed by the invention 100. The invention 100 conceals a package 181 left in an outdoor environment 182. A common scenario for using the invention 100 is to conceal a package 181 left unattended by a commercial delivery service. The invention 100 comprises a blind sheeting 101 and a plurality of weights 102. The blind sheeting 101 forms an opaque sheeting placed over the package 181. The blind sheeting 101 prevents the package 181 from being seen. The plurality of weights 102 secure the edges of the blind sheeting 101 such that the wind will not move the blind sheeting 101 thereby attracting attention to the invention 100. In the first potential embodiment of the disclosure, the blind sheeting 101 further comprises the visual patterns and forms of camouflage appropriate for the outdoor environment 182.

The blind sheeting 101 is a sheeting formed in a rectilinear shape. The blind sheeting 101 is draped over the package 181. The blind sheeting 101 is an opaque structure that forms a barrier that blocks the view of the package 181. The blind sheeting 101 has formed on it the visual patterns and forms required to create a camouflage 115 that is specific and appropriate for the outdoor environment 182. In the first potential embodiment of the disclosure, the camouflage 115 is printed directly on the blind sheeting 101. Methods to print patterns on a sheeting are well-known and documented in the textile arts. The blind sheeting 101 comprises a master sheeting 110, a first weight tab 111, a second weight tab 112, a third weight tab 113, and a fourth weight tab 114.

The master sheeting 110 is a sheeting that is cut in a rectangular shape. The master sheeting 110 forms the opaque structure that blocks the visibility of the package 181. The master sheeting 110 further comprises a first miter cut 191, a second miter cut 192, a third miter cut 193, and a fourth miter cut 194. The master sheeting 110 is further defined with a first edge 131, a second edge 132, a third edge 133, and a fourth edge 134.

The first miter cut 191 is a vent that is formed in the master sheeting 110. The first miter cut 191 aids the master sheeting 110 in draping over the package 181. The second miter vent 192 is a vent that is formed in the master sheeting 110. The second miter cut 192 aids the master sheeting 110 in draping over the package 181. The third miter cut 193 is a vent that is formed in the master sheeting 110. The third miter cut 193 aids the master sheeting 110 in draping over the package 181. The fourth miter cut 194 is a vent that is formed in the master sheeting 110. The fourth miter cut 194 aids the master sheeting 110 in draping over the package 181.

In the first potential embodiment of the disclosure, the master sheeting 110 is a textile material. The textile that forms the master sheeting 110 comprises poly-para-phenylene terephthalamide (CAS 25035-37-4) yarns. The poly-para-phenylene terephthalamide (CAS 25035-37-4) yarns are used to enhance the durability of the blind sheeting 101. The master sheeting 110 has a camouflage 115 printed on it. The textile that forms the master sheeting 110 is treated with perfluorobutanesulfonic acid (CAS 375-73-5). The use of perfluorobutanesulfonic acid (CAS 375-73-5) enhances the water resistance of the blind sheeting 101. The camouflage 115 is a pattern that is intended to cause the blind sheeting 101 to blend into the outdoor environment 182.

The first weight tab 111 is a sheeting cut in a rectangular shape. The first weight tab 111 forms a structure that contains the first weight 121. The first weight tab 111 is formed from the same textile material as the master sheeting 110. The first weight tab 111 attaches the first weight 121 to the master sheeting 110. The first weight tab 111 further comprises a first seam 161, a second seam 162, a third seam 163, and a fourth seam 164. The first weight tab 111 is further defined with a fifth edge 135, a sixth edge 136, a seventh edge 137, and an eighth edge 138.

The second weight tab 112 is a sheeting cut in a rectangular shape. The second weight tab 112 forms a structure that contains the second weight 122. The second weight tab 112 is formed from the same textile material as the master sheeting 110. The second weight tab 112 attaches the second weight 122 to the master sheeting 110. The second weight tab 112 further comprises a fifth seam 165, a sixth seam 166, a seventh seam 167, and an eighth seam 168. The second weight tab 112 is further defined with a ninth edge 139, a tenth edge 140, an eleventh edge 141, and a twelfth edge 142.

The third weight tab 113 is a sheeting cut in a rectangular shape. The third weight tab 113 forms a structure that contains the third weight 123. The third weight tab 113 is formed from the same textile material as the master sheeting 110. The third weight tab 113 attaches the third weight 123 to the master sheeting 110. The third weight tab 113 further comprises a ninth seam 169, a tenth seam 170, an eleventh seam 171, and a twelfth seam 172. The third weight tab 113 is further defined with a thirteenth edge 143, a fourteenth edge 144, a fifteenth edge 145, and a sixteenth edge 146.

The fourth weight tab 114 is a sheeting cut in a rectangular shape. The fourth weight tab 114 forms a structure that contains the fourth weight 124. The fourth weight tab 114 is formed from the same textile material as the master sheeting 110. The fourth weight tab 114 attaches the fourth weight 124 to the master sheeting 110. The fourth weight tab 114 further comprises a thirteenth seam 173, a fourteenth seam 174, a fifteenth seam 175, and a sixteenth seam 176. The fourth weight tab 114 is further defined with a seventeenth edge 147, an eighteenth edge 148, a nineteenth edge 149, and a twentieth edge 150.

The plurality of weights 102 attach to the blind sheeting 101. Each of the plurality of weights 102 is a rectangular block formed from a high-density material. Suitable high-density materials include, but are not limited to, iron, nickel, lead, platinum, and osmium. The plurality of weights 102 anchor the blind sheeting 101 to the ground 183 such that the wind will not cause the blind sheeting 101 to dislodge when the invention 100 is in use.

The plurality of weights 102 comprises a first weight 121, a second weight 122, a third weight 123, and a fourth weight 124. The first weight 121 is a metal block that attaches to the master sheeting 110. The second weight 122 is a metal block that attaches to the master sheeting 110. The third weight 123 is a metal block that attaches to the master sheeting 110. The fourth weight 124 is a metal block that attaches to the master sheeting 110. The first weight 121, the second weight 122, the third weight 123, and the fourth weight 124 are identical.

The assembly of the invention 100 is described in the following ten paragraphs.

The first miter cut 191 is a straight line cut formed from the corner formed by the first edge 131 and the second edge 132 to the center of the master sheeting 110. The second miter cut 192 is a straight line cut formed from the corner formed by the second edge 132 and the third edge 133 to the center of the master sheeting 110. The third miter cut 193 is a straight line cut formed from the corner formed by the third edge 133 and the fourth edge 134 to the center of the master sheeting 110. The fourth miter cut 194 is a straight line cut formed from the corner formed by the fourth edge 134 and the first edge 131 to the center of the master sheeting 110.

The first weight tab 111 forms a pocket that encloses the first weight 121. The first weight 121 is centered on the first weight tab 111. The seventh edge 137 of the first weight tab 111 folds over and encloses the first weight 121. The second seam 162 attaches the seventh edge 137 to the face of the first weight tab 111. The third seam 163 attaches the sixth edge 136 of the first weight tab 111 to itself. The fourth seam 164 attaches the eighth edge 138 of the first weight tab 111 to itself.

The second weight tab 112 forms a pocket that encloses the second weight 122. The second weight 122 is centered on the second weight tab 112. The eleventh edge 141 of the second weight tab 112 folds over and encloses the second weight 122. The sixth seam 166 attaches the eleventh edge 141 to the face of the second weight tab 112. The seventh seam 167 attaches the tenth edge 140 of the second weight tab 112 to itself. The eighth seam 168 attaches the twelfth edge 142 of the second weight tab 112 to itself.

The third weight tab 113 forms a pocket that encloses the third weight 123. The third weight 123 is centered on the third weight tab 113. The fifteenth edge 145 of the third weight tab 113 folds over and encloses the third weight 123. The tenth seam 170 attaches the fifteenth edge 145 to the face of the third weight tab 113. The eleventh seam 171 attaches the fourteenth edge 144 of the third weight tab 113 to itself. The twelfth seam 172 attaches the sixteenth edge 146 of the third weight tab 113 to itself.

The fourth weight tab 114 forms a pocket that encloses the fourth weight 124. The fourth weight 124 is centered on the fourth weight tab 114. The nineteenth edge 149 of the fourth weight tab 114 folds over and encloses the fourth weight 124. The fourteenth seam 174 attaches the nineteenth edge 149 to the face of the fourth weight tab 114. The fifteenth seam 175 attaches the eighteenth edge 148 of the fourth weight tab 114 to itself. The sixteenth seam 176 attaches the twentieth edge 150 of the fourth weight tab 114 to itself.

The first seam 161 attaches the fifth edge 135 of the first weight tab 111 to the first edge 131 of the master sheeting 110 such that the first weight tab 111 is centered between the fourth miter cut 194 and the first miter cut 191.

The fifth seam 165 attaches the ninth edge 139 of the second weight tab 112 to the second edge 132 of the master sheeting 110 such that the second weight tab 112 is centered between the first miter cut 191 and the second miter cut 192.

The ninth seam 169 attaches the thirteenth edge 143 of the third weight tab 113 to the third edge 133 of the master sheeting 110 such that the third weight tab 113 is centered between the second miter cut 192 and the third miter cut 193.

The thirteenth seam 173 attaches the seventeenth edge 147 of the fourth weight tab 114 to the fourth edge 134 of the master sheeting 110 such that the fourth weight tab 114 is centered between the third miter cut 193 and the fourth miter cut 194.

In the first potential embodiment of the disclosure, the first seam 161, the second seam 162, the third seam 163, the fourth seam 164, the fifth seam 165, the sixth seam 166, the seventh seam 167, the eighth seam 168, the ninth seam 169, the tenth seam 170, the eleventh seam 171, the twelfth seam 172, the thirteenth seam 173, the fourteenth seam 174, the fifteenth seam 175, and the sixteenth seam 176 are sewn seams. To use the invention 100, the blind sheeting 101 is draped over the package 181 and the weights are placed on the ground 183 to hold the package 181 in place.

The following definitions were used in this disclosure:

Blind: As used in this disclosure, a blind is a structure that is used to conceal a person or an object.

Camouflage: As used in this disclosure, camouflage refers to a visual pattern and form applied to an object. The visual pattern and form are intended to cause the object to blend into the environment surrounding the object. In this scenario, the camouflage disguises the object by making the object difficult to see while the object is in the environment.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Drape: As used in this disclosure, to drape means to arrange in a fabric in flowing lines and folds.

Miter: As used in this disclosure, a miter refers to a seam that joins a miter cut together.

Miter Cut: As used in this disclosure, a miter cut refers to a vent formed in a rectilinear textile that is cut through a corner of the rectilinear textile.

Opaque: As used in this disclosure, opaque refers to an object or material that prevents the passage of radiation through the object or material.

Perfluorobutanesulfonic acid: As used in this disclosure, perfluorobutanesulfonic acid (CAS 375-73-5) is a surfactant, technically a fluorosurfactant, which is commonly applied to a textile as a water repellant.

Pocket: As used in this disclosure, a pocket is a small pouch or storage space formed into an object. Pockets are often formed by joining a second textile or a second sheeting to a first textile or a first sheeting, respectively, by sewing or heat sealing respectively.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as a textile, a plastic, or a metal foil, in the form of a thin flexible layer or layers.

Textile: As used in this disclosure, a textile is a material that is woven, knitted, braided or felted. Synonyms in common usage for this definition include fabric and cloth.

Vent: As used in this disclosure, a vent is a cut formed in a fabric such that the cut goes through an edge of the fabric.

Yarn: As used in this disclosure, a yarn is a continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A concealment apparatus comprising a blind sheeting and a plurality of weights;

wherein the plurality of weights attach to the blind sheeting;

wherein the concealment apparatus further comprises the visual patterns and forms of camouflage appropriate for the outdoor environment;

wherein the concealment apparatus is a blind;

wherein the concealment apparatus is adapted for use in an outdoor environment;
wherein the concealment apparatus is configured for use with a package;
wherein the blind sheeting is draped over the package;
wherein the blind sheeting comprises a master sheeting, a first weight tab, a second weight tab, a third weight tab, and a fourth weight tab;
wherein the first weight tab, the second weight tab, the third weight tab, and a fourth weight tab attach to the master sheeting;
wherein the master sheeting is further defined with a first edge, a second edge, a third edge, and a fourth edge;
wherein the master sheeting further comprises a first miter cut, a second miter cut, a third miter cut, and a fourth miter cut;
wherein the first weight tab further comprises a first seam, a second seam, a third seam, and a fourth seam;
wherein the first weight tab is further defined with a fifth edge, a sixth edge, a seventh edge, and an eighth edge;
wherein the second weight tab further comprises a fifth seam, a sixth seam, a seventh seam, and an eighth seam;
wherein the second weight tab is further defined with a ninth edge, a tenth edge, an eleventh edge, and a twelfth edge;
wherein the third weight tab further comprises a ninth seam, a tenth seam, an eleventh seam, and a twelfth seam;
wherein the third weight tab is further defined with a thirteenth edge, a fourteenth edge, a fifteenth edge, and a sixteenth edge;
wherein the fourth weight tab further comprises a thirteenth seam, a fourteenth seam, a fifteenth seam, and a sixteenth seam;
wherein the fourth weight tab is further defined with a seventeenth edge, an eighteenth edge, a nineteenth edge, and a twentieth edge;
wherein the first seam attaches the fifth edge of the first weight tab to the first edge of the master sheeting such that the first weight tab is centered between the fourth miter cut and the first miter cut;
wherein the fifth seam attaches the ninth edge of the second weight tab to the second edge of the master sheeting such that the second weight tab is centered between the first miter cut and the second miter cut;
wherein the ninth seam attaches the thirteenth edge of the third weight tab to the third edge of the master sheeting such that the third weight tab is centered between the second miter cut and the third miter cut;
wherein the thirteenth seam attaches the seventeenth edge of the fourth weight tab to the fourth edge of the master sheeting such that the fourth weight tab is centered between the third miter cut and the fourth miter cut;
wherein the blind sheeting is a sheeting formed in a rectilinear shape;
wherein the blind sheeting is an opaque structure;
wherein the blind sheeting has formed on it the visual patterns and forms required to create a camouflage that is appropriate for the outdoor environment;
wherein the master sheeting is a sheeting cut in a rectangular shape;
wherein the master sheeting forms the opaque structure of the blind sheeting;
wherein the first miter cut is a vent;
wherein the second miter vent is a vent;
wherein the third miter cut is a vent;
wherein the fourth miter cut is a vent.

2. The concealment apparatus according to claim 1
wherein the master sheeting is a textile material;
wherein the first weight tab is a sheeting;
wherein the first weight tab is cut a rectangular shape;
wherein the second weight tab is a sheeting;
wherein the second weight tab cut in a rectangular shape;
wherein the third weight tab is a sheeting;
wherein the third weight tab is cut in a rectangular shape;
wherein the fourth weight tab is a sheeting;
wherein the fourth weight tab is cut in a rectangular shape.

3. The concealment apparatus according to claim 2 wherein the master sheeting is a textile material.

4. The concealment apparatus according to claim 3
wherein the first weight tab forms a structure that contains the first weight;
wherein the second weight tab forms a structure that contains the second weight;
wherein the third weight tab forms a structure that contains the third weight;
wherein the fourth weight tab forms a structure that contains the fourth weight.

5. The concealment apparatus according to claim 4
wherein the first weight tab is formed from the same textile material as the master sheeting;
wherein the second weight tab is formed from the same textile material as the master sheeting;
wherein the third weight tab is formed from the same textile material as the master sheeting;
wherein the fourth weight tab is formed from the same textile material as the master sheeting.

6. The concealment apparatus according to claim 5
wherein the plurality of weights comprises a first weight, a second weight, a third weight, and a fourth weight;
wherein the first weight is a metal structure;
wherein the second weight is a metal structure;
wherein the third weight is a metal structure;
wherein the fourth weight is a metal structure.

7. The concealment apparatus according to claim 6 wherein the first weight, the second weight, the third weight, and the fourth weight are identical.

8. The concealment apparatus according to claim 7
wherein the first weight attaches to the master sheeting;
wherein the second weight attaches to the master sheeting;
wherein the third weight attaches to the master sheeting;
wherein the fourth weight attaches to the master sheeting.

9. The concealment apparatus according to claim 8
wherein the first miter cut is a straight line cut formed from the corner formed by the first edge and the second edge to the center of the master sheeting;
wherein the second miter cut is a straight line cut formed from the corner formed by the second edge and the third edge to the center of the master sheeting;
wherein the third miter cut is a straight line cut formed from the corner formed by the third edge and the fourth edge to the center of the master sheeting;
wherein the fourth miter cut is a straight line cut formed from the corner formed by the fourth edge and the first edge to the center of the master sheeting.

10. The concealment apparatus according to claim 9
wherein the first weight tab forms a pocket that encloses the first weight;
wherein the first weight is centered on the first weight tab;
wherein the seventh edge of the first weight tab folds over and encloses the first weight;
wherein the second seam attaches the seventh edge to the face of the first weight tab;

wherein the third seam attaches the sixth edge of the first weight tab to itself;

wherein the fourth seam attaches the eighth edge of the first weight tab to itself;

wherein the second weight tab forms a pocket that encloses the second weight;

wherein the second weight is centered on the second weight tab;

wherein the eleventh edge of the second weight tab folds over and encloses the second weight;

wherein the sixth seam attaches the eleventh edge to the face of the second weight tab;

wherein the seventh seam attaches the tenth edge of the second weight tab to itself;

wherein the eighth seam attaches the twelfth edge of the second weight tab to itself;

wherein the third weight tab forms a pocket that encloses the third weight;

wherein the third weight is centered on the third weight tab;

wherein the fifteenth edge of the third weight tab folds over and encloses the third weight;

wherein the tenth seam attaches the fifteenth edge to the face of the third weight tab;

wherein the eleventh seam attaches the fourteenth edge of the third weight tab to itself;

wherein the twelfth seam attaches the sixteenth edge of the third weight tab to itself;

wherein the fourth weight tab forms a pocket that encloses the fourth weight;

wherein the fourth weight is centered on the fourth weight tab;

wherein the nineteenth edge of the fourth weight tab folds over and encloses the fourth weight;

wherein the fourteenth seam attaches the nineteenth edge to the face of the fourth weight tab;

wherein the fifteenth seam attaches the eighteenth edge of the fourth weight tab to itself;

wherein the sixteenth seam attaches the twentieth edge of the fourth weight tab to itself.

11. The concealment apparatus according to claim 10 wherein the first seam, the second seam, the third seam, the fourth seam, the fifth seam, the sixth seam, the seventh seam, the eighth seam, the ninth seam, the tenth seam, the eleventh seam, the twelfth seam, the thirteenth seam, the fourteenth seam, the fifteenth seam, and the sixteenth seam are sewn seams.

12. The concealment apparatus according to claim 11 wherein the camouflage is printed on the master sheeting.

13. The concealment apparatus according to claim 12 wherein the textile that forms the master sheeting comprises yarns that contain poly-para-phenylene terephthalamide (CAS 25035-37-4);

wherein the textile that forms the master sheeting is treated with perfluorobutanesulfonic acid (CAS 375-73-5).

* * * * *